US005158202A

United States Patent [19]

Kosonen et al.

[11] Patent Number: 5,158,202

[45] Date of Patent: Oct. 27, 1992

[54] PLATE

[75] Inventors: Olavi Kosonen, Helsinki; Viljo Röytiö, Vantaa; Camilla Moberg, Pohjan Kuru, all of Finland

[73] Assignee: Hackman Arabia Oy Ab, Helsinki, Finland

[21] Appl. No.: 665,266

[22] Filed: Mar. 6, 1991

[30] Foreign Application Priority Data

Mar. 13, 1990 [FI] Finland ..... 901235

[51] Int. Cl.[5] ..... B65D 25/00

[52] U.S. Cl. ..... 220/574; D7/584

[58] Field of Search ..... 220/574, 636; 206/505, 206/511; D7/584, 586, 587, 580

[56] References Cited

U.S. PATENT DOCUMENTS

| | | | |
|---|---|---|---|
| D. 166,937 | 6/1952 | Wagner | D7/584 |
| 1,251,549 | 1/1918 | McDonald et al. | 220/574 |
| 2,178,274 | 10/1939 | Ratner | 220/574 |
| 2,657,558 | 11/1953 | Cowan | 220/574 |
| 3,190,486 | 6/1965 | Rech | D7/586 X |

FOREIGN PATENT DOCUMENTS

| | | | |
|---|---|---|---|
| 459258 | 10/1913 | France | D7/584 X |

*Primary Examiner*—Steven M. Pollard

*Attorney, Agent, or Firm*—Dellett, Smith-Hill and Bedell

[57] ABSTRACT

A glazed ceramic dinner plate has inner and outer foot-rings that protrude from its underside and have their bottom surfaces at upper and lower horizontal levels when the plate is disposed horizontally. The foot-ring having its bottom surface at the upper level is glazed on its bottom surface and the other foot-ring is not glazed.

21 Claims, 2 Drawing Sheets

PLATE

BACKGROUND OF THE INVENTION

This invention relates to a generally flat glazed article that is produced by firing in a kiln, such as a glazed dinner plate.

A glazed dinner plate is fired while standing on a saggar. Because the glaze will stick fast to the saggar during the firing process, it is important that any part of the plate that will be in contact with the saggar should be free from glaze.

A typical plate has a foot-ring on which it stands. This foot-ring is a small protrusion from the underside of the generally flat plate. Normally, it has the same general form as the outline of the plate, being for instance circular on a circular plate and, for ease of manufacture, a continuous circle. However, it is also possible to have a foot-ring which comprises only segments of the circle or the other appropriate geometric shape, which is normally similar to the shape of the outline of the plate. In any case, the bottom of this foot-ring is the only part of the plate to come in contact with the saggar during firing. Consequently, all parts of the plate other than the bottom of the foot-ring may be covered with glaze.

According to the conventional manufacturing technique, the plate is first totally covered with glaze and the bottom of the foot-ring is wiped clean prior to firing. As a result the bottom of the foot-ring remains unglazed, leaving the finished plate with a rough surface which, even after polishing, remains slightly abrasive. When plates are stacked, one upon another, the unglazed bottom of the foot-ring of one plate stands upon the glazed upper surface of the plate beneath, and can scratch the glaze. When large numbers of plates are staked on a regular basis, such as in an hotel or other catering establishment, the risk of scratching is increased. The very action of stacking or unstacking plates means that the unglazed bottom of the foot-ring is drawn across the glazed upper surface of the plate beneath. In a tall stack the weight of the plates above presses each plate hard against the one beneath. The daily movement of such stacks of plates from wash place, to storage area, to dining area, and back again, tends further to increase this scratching effect by grinding the plates one upon another, so that the glaze on the upper surface of the plates becomes dull and possibly discolored.

Various techniques have been tried to obviate or reduce this scratching effect. One solution is to glaze the bottom of the plate's foot-ring so that it will be as smooth as the rest of the plate. This is achieved by glazing the whole plate, and then firing it while it is supported from below on three pins. However, this requires that the plate be sufficiently rigid to stand on the pins without distortion. This necessary rigidity can only be achieved by pre-firing the plate, which makes the manufacturing process more complicated and expensive. In addition, the three pins leave small defects in the glaze of the underside of the plate. Moreover, because such plates are uniformly shiny, they tend to slide about when stacks of plates are moved, increasing the risk of breakages.

Another method of avoiding the problem is to shape the plate so that, when it is stacked on a similar plate, only the rim of the plate is in contact with the next plate. Such a technique requires that the rim of the plate has an edge portion with an enlarged vertical extension to enable one plate to "hang" in another without its foot-ring touching the upper surface of the plate below. This gives the plate a "bowl" profile, which may not be acceptable for normal dinner plates. Such plates are also more difficult to handle when stacking and unstacking them in large numbers.

SUMMARY OF THE INVENTION

The invention may be used to avoid the drawbacks mentioned above and yet provide a plate which may be manufactured economically by normal production methods and whose profile is generally conventional. This is achieved by providing the plate with inner and outer foot-rings protruding from its underside and having their bottom surfaces at different horizontal levels, and only the foot-ring having its bottom surface on a higher level is glazed on its bottom surface. To ensure maximum stability of the plate the foot-rings have the same general outline as the plate. Preferably, the plate and the foot-rings are basically circular.

In a preferred embodiment of the invention, the foot-ring whose bottom surface is on a lower level is the inner foot-ring, so that the plate stands on the inner foot-ring while being fired. As the outer foot-ring does not touch the saggar on which the inner foot-ring is standing during the firing process, it may be totally glazed with the rest of the plate. Further, the upper surface of the plate is so shaped that, when the plate is stacked on another similar plate, only the outer, totally glazed foot-ring touches the plate beneath, whereas the rough unglazed inner foot-ring remains out of contact with the plate beneath. Thereby the wear caused by the unglazed bottom surface of a foot-ring scratching the plate beneath is minimized.

In order to enable such plates to stand more steadily one upon another, in a preferred embodiment of the invention the upper surface of the plate is provided with a small step, to coincide with the outside of the outer foot-ring of the plate above. When similar plates of this design are stacked, the outer foot-ring of a plate engages with this step on the upper surface of the plate beneath and this prevents it from sliding from side to side when being transported. It is possible to form this step as one side of a shallow groove. This gives the benefit that the groove may also be used for decorative purposes. In either case the dimensions of the step are such that sufficient clearance remains between the edges of the plates to ensure ease of handling.

When stacking and unstacking plates of this design, only the fully glazed outer foot-ring is drawn across the glazed surface of the plate beneath. Even if the unglazed bottom surface of the inner foot-ring may theoretically contact the plate beneath, this does not happen during a normal stacking or unstacking operation, provided that the plates are properly formed.

In order to make certain that the plate stands steadily on a table or similar flat supporting surface, while at the same time allowing proper space for the outer foot-ring, the inner foot-ring should preferably have a diameter of 45% to 70% of the diameter of the plate. For obtaining a good pile stability it is preferred that the outer foot-ring should have a diameter of 65% to 85% of the diameter of the plate. For obtaining a suitable difference in horizontal level of the two foot-rings while still keeping the plate fairly flat, the distance between the two foot-rings should preferably be 7% to 15% of the diameter of the plate.

BRIEF DESCRIPTION OF THE DRAWINGS

The invention will now be described, by way of example, with reference to the accompanying drawings, in which.

DETAILED DESCRIPTION

Figure 1:
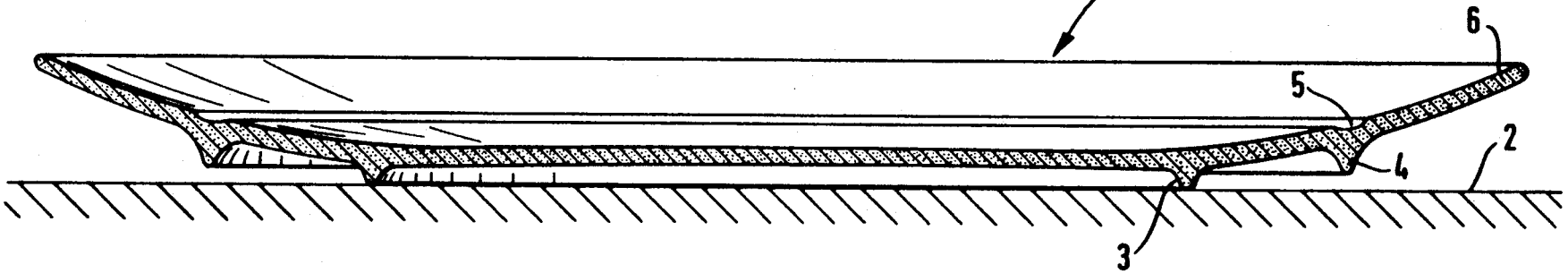
FIG. 1 is a sectional view of a plate according to the invention, standing on a flat surface.

FIG. 1 shows a plate 1 according to the invention standing on a flat supporting surface 2. The plate 1 is circular and is formed with inner and outer circular foot-rings 3 and 4, which are concentric with the plate. The inner foot-ring 3 is in contact with the flat surface 2, but the outer foot-ring 4 is at a distance of about one millimeter or more above the surface 2. There is a circular step or groove 5 on the upper surface of the plate for receiving the fully glazed outer foot-ring 4 when similar plates are stacked. Because of the difficulty of achieving accurate dimensions in ceramic dinner plates, there must be a reasonable dimensional tolerance in the step and foot-ring fit in order to ensure that the bottom of the foot-ring 4 of the upper plate will be received in the step 5 of the lower plate when the upper plate is placed concentrically on the lower plate. Therefore, the inner and outer radii of the step 5 are, respectively, slightly less than and slightly greater than the inner and outer radii of the bottom of the outer foot-ring 4.

Figure 2:
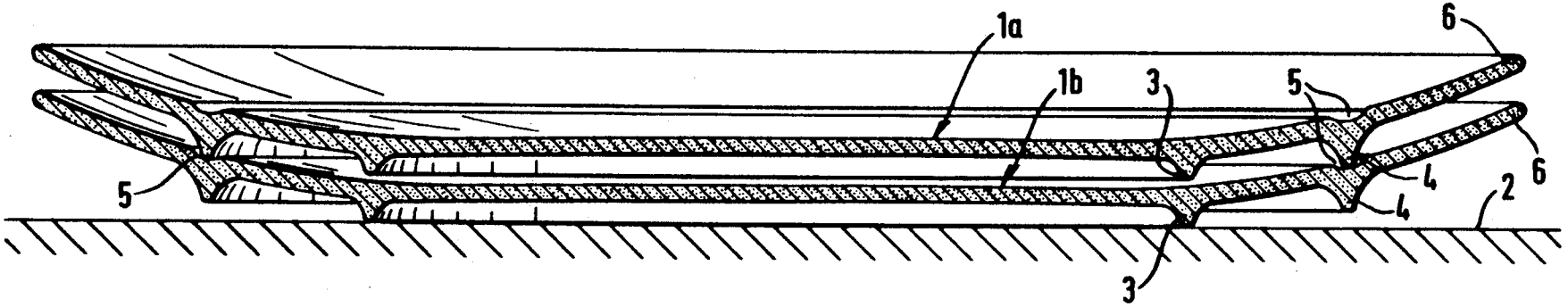
FIG. 2 is a sectional view of a plate according to the invention, standing on a similar plate.

FIG. 2 shows two plates 1*a* and 1*b* according to the invention stacked one upon the other. The upper plate 1*a* rests on the lower plate through its fully glazed outer foot-ring 4 whose bottom engages in the step 5 of the lower plate 1*b*. The partially unglazed inner foot-ring 3 of the upper plate 1*a* does not touch the lower plate 1*b* at all.

Figure 3A:
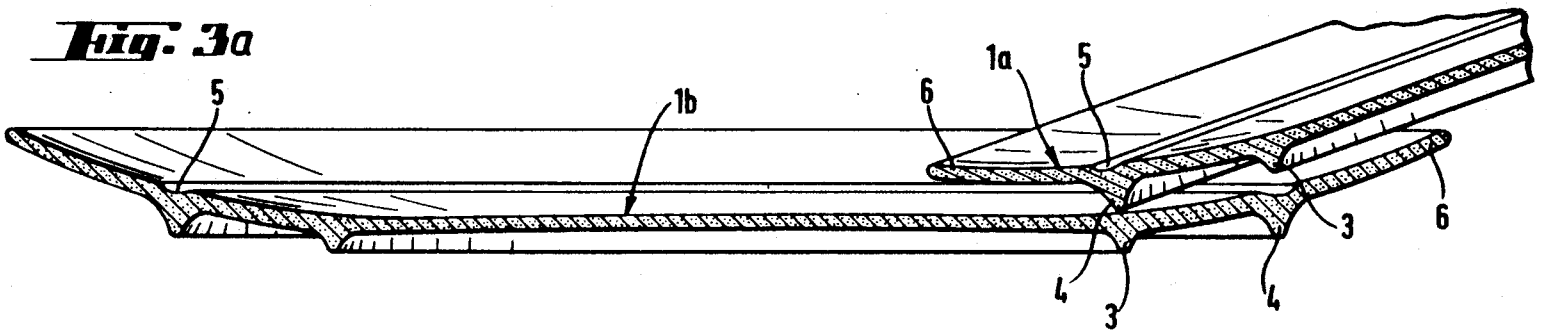
FIGS. 3*a*, 3*b* and 3*c* are sectional views showing a plate according to the invention being drawn over a similar plate.
Figure 3B:
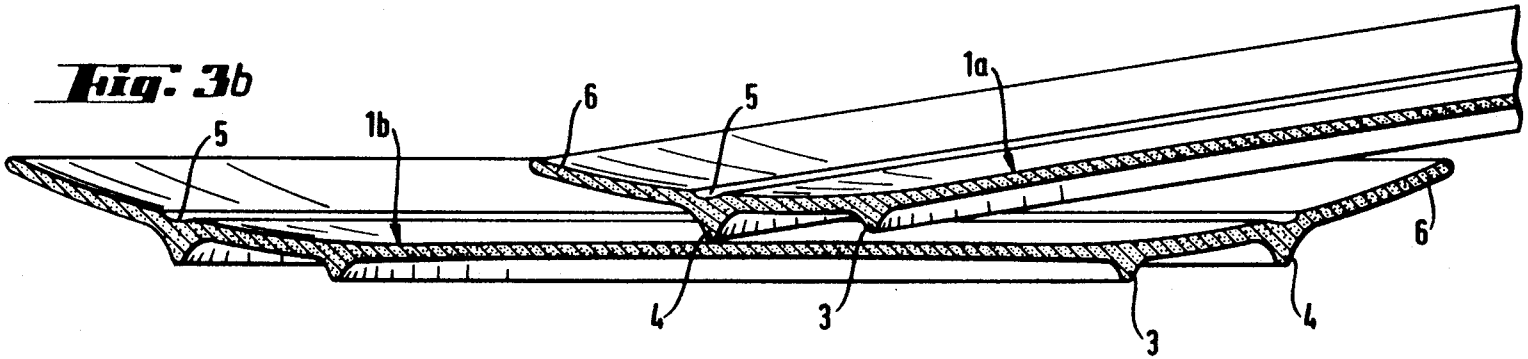
Figure 3C:
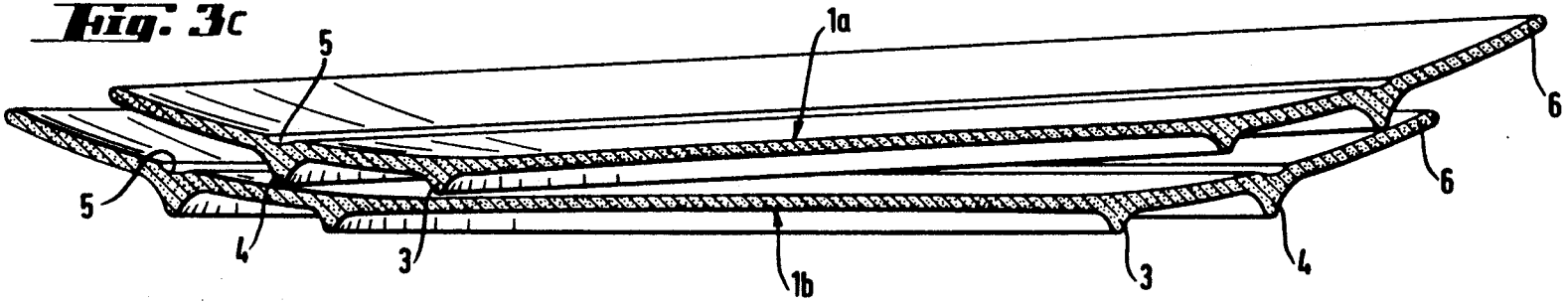

FIGS. 3*a*, 3*b* and 3*c* show plate 1*a* being drawn across plate 1*b*, for instance when stacking or unstacking. During a normal stacking or unstacking operation, the glazed foot-ring 4 of the upper plate 1*a* contacts the lower plate 1*b* at or near its rim and prevents the partially unglazed inner foot-ring 3 from contacting the lower plate. The inner foot-ring of the upper plate does not contact the lower plate during normal handling.

The invention is not limited to the embodiment shown, but several modifications thereof are feasible within the scope of the attached claims.

We claim:

1. A glazed article, which is generally flat and is produced by firing in a kiln, having inner and outer foot-rings that protrude from its underside and have their bottom surfaces at upper and lower horizontal levels when the article is disposed horizontally, and wherein only the foot-ring having its bottom surface at the upper level is glazed on its bottom surface.

2. An article according to claim 1, wherein the foot-rings are concentric.

3. An article according to claim 1, wherein the outer and inner foot-rings have essentially the same general outline as the article.

4. An article according to claim 3, wherein the article is substantially circular and the foot-rings are substantially circular.

5. An article according to claim 4, wherein the inner foot-ring has a diameter of 45% to 70% of the diameter of the article.

6. An article according to claim 4, wherein the outer foot-ring has a diameter of 65% to 85% of the diameter of the article.

7. An article according to claim 4, wherein the distance between the inner and outer foot-rings is 7% to 15% the diameter of the article.

8. An article according to claim 1, wherein the inner foot-ring has its bottom surface at a lower level than the bottom surface of the outer foot-ring, so that when the article is standing on a flat surface, only the inner foot-ring touches the surface.

9. An article according to claim 8, wherein the upper surface of the article is so formed that when the article stands on another similar article, only the outer foot-ring touches the article beneath.

10. An article according to claim 8, wherein the article has a step on its upper surface, said step having essentially the same general outline as the outer foot-ring and being slightly larger than the outer foot-ring, so that when two similar articles are placed one on top of the other, the outer foot-ring of the upper article engages in the step of the article beneath.

11. An article according to claim 10, wherein said step is one side of a groove that receives the outer foot-ring of the article above, when one article is standing on another.

12. An article according to claim 8, wherein the article is so shaped that, when it is drawn across another similar article beneath it, substantially all contact between the upper article and the article beneath takes place between the outer foot-ring of the upper article and the upper surface of the article beneath.

13. A glazed ceramic dinner plate having inner and outer foot-rings that protrude from its underside and have their bottom surfaces at upper and lower horizontal levels when the plate is disposed horizontally, and wherein only the foot-ring having its bottom surface at the upper level is glazed on its bottom surface.

14. A plate according to claim 13, being substantially circular, and wherein the foot-rings are substantially circular and substantially concentric with the plate.

15. A plate according to claim 14, wherein the inner foot-ring has a diameter of 45% to 70% of the diameter of the plate, the outer foot-ring has a diameter of 65% to 85% of the diameter of the plate, and the radial distance between the inner and outer foot-rings is 7% to 15% the diameter of the plate.

16. A plate according to claim 13, wherein the inner foot-ring has its bottom surface at a lower level than the bottom surface of the outer foot-ring, so that when the plate is standing on a flat surface, only the inner foot-ring touches the surface.

17. A plate according to claim 16, being so formed that when the plate stands concentrically on another similar plate, only the outer foot-ring touches the plate beneath.

18. A plate according to claim 16, being formed with a step on its upper surface, said step having essentially the same general outline as the outer foot-ring and being slightly larger than the outer foot-ring, so that when two similar plates are placed concentrically one on top of the other, the outer foot-ring of the upper plate engages in the step of the plate beneath.

19. A plate according to claim 18, wherein said step is one side of a groove that receives the outer foot-ring of the plate above, when one plate is placed concentrically on another.

20. A plate according to claim 16, being shaped so that when it is drawn across another similar plate beneath it, substantially all contact between the plate and the plate beneath takes place between the outer foot-ring of the upper plate and the upper surface of the plate beneath.

21. A method of manufacturing a glazed ceramic flatware plate comprising:

forming a plate of ceramic material in the unfired state, the plate having inner and outer foot-rings that protrude from its underside and have their bottom surfaces at upper and lower horizontal levels when the plate is horizontal, applying glaze to the plate in a manner such that the foot-ring bottom surface at the upper horizontal level is glazed but the foot-ring bottom surface at the lower horizontal level is not glazed, and firing the plate while supporting it on a surface in contact with the foot-ring bottom surface at the lower horizontal level.

* * * * *